US010151315B2

(12) United States Patent
Gahlot et al.

(10) Patent No.: US 10,151,315 B2
(45) Date of Patent: Dec. 11, 2018

(54) HORIZONTAL PUMPING SYSTEM WITH PRIMARY STAGE ASSEMBLY AND SEPARATE NPSH STAGE ASSEMBLY

(71) Applicant: GE Oil & Gas ESP, Inc., Oklahoma City, OK (US)

(72) Inventors: Vishal Gahlot, Moore, OK (US); Colby Lane Loveless, Oklahoma City, OK (US); Mark James, Oklahoma City, OK (US); Scott Richard Erler, Oklahoma City, OK (US)

(73) Assignee: GE Oil & Gas ESP, Inc., Oklahoma City, OK (US)

( * ) Notice: Subject to any disclaimer, the term of this patent is extended or adjusted under 35 U.S.C. 154(b) by 439 days.

(21) Appl. No.: 14/828,623

(22) Filed: Aug. 18, 2015

(65) Prior Publication Data

US 2017/0051752 A1 Feb. 23, 2017

(51) Int. Cl.

| | |
|---|---|
| ***F04D 13/02*** | (2006.01) |
| ***F04D 29/62*** | (2006.01) |
| ***F04D 29/22*** | (2006.01) |
| ***F04D 1/06*** | (2006.01) |

(52) U.S. Cl.

CPC ..... *F04D 13/02* (2013.01); *F04D 1/06* (2013.01); *F04D 29/2277* (2013.01); *F04D 29/628* (2013.01)

(58) Field of Classification Search

CPC ..... F04D 29/2261; F04D 29/2277; F04D 29/2205; F04D 29/426; F04D 29/445; F04D 29/043; F04D 13/02; F04D 1/06

See application file for complete search history.

(56) References Cited

U.S. PATENT DOCUMENTS

| | | | | |
|---|---|---|---|---|
| 4,097,186 A * | 6/1978 | Budris | F04D 1/066 415/143 |
| 7,455,497 B2 * | 11/2008 | Lee | F04D 13/10 415/72 |
| 2013/0121804 A1 * | 5/2013 | Oliphant | F01D 5/141 415/1 |

FOREIGN PATENT DOCUMENTS

| | | | |
|---|---|---|---|
| DE | 102005060895 A1 * | 6/2007 | F04D 5/003 |

* cited by examiner

*Primary Examiner* — Justin Seabe
*Assistant Examiner* — Brian P Wolcott
(74) *Attorney, Agent, or Firm* — Crowe & Dunlevy, P.C.

(57) ABSTRACT

A horizontal pumping system has a motor, a suction chamber and a pump driven by the motor. The pump includes a primary stage assembly and a low NPSH stage assembly connected between the primary stage assembly and the suction chamber. The low NPSH stage assembly is external to the primary stage assembly. The low NPSH stage assembly includes a diffuser connected to the pump housing and a low NPSH impeller contained within the diffuser. The diameter of the low NPSH stage assembly is optionally larger than the diameter of the primary stage assembly.

15 Claims, 9 Drawing Sheets

HORIZONTAL PUMPING SYSTEM WITH PRIMARY STAGE ASSEMBLY AND SEPARATE NPSH STAGE ASSEMBLY

FIELD OF THE INVENTION

This invention relates generally to the field of pumping systems, and more particularly, but not by way of limitation, to an improved pump design for use in low net positive suction head (NPSH) applications.

BACKGROUND

Horizontal pumping systems are used in various industries for a variety of purposes. In many cases, a multistage vertical turbine pump is horizontally mounted on a skid-supported frame and used in a horizontal orientation. For example, in the oil and gas industry horizontal pumping systems are used to pump fluids, such as water separated from oil, to a remote destination, such as a tank or disposal well. Typically these horizontal pumping systems include a pump, a motor, and a suction housing positioned between the pump and the motor. A thrust chamber is also included between the motor and the suction housing. The pump includes a discharge assembly that is connected to downstream piping.

In downhole pumping applications, the pressure of the fluid at the pump inlet is often increased by head pressure created by the column of fluid in the wellbore. In surface-based pumping systems, however, the net positive suction head available ($NPSH_A$) may be much lower. To match the $NPSH_A$ to the suction pressure required by the pump ($NPSH_R$), designers have used a separate boost pump that charges the fluid to a $NPSH_A$ that matches or exceeds the $NPSH_R$ required by the horizontal pump. The use of a separate boost pump is expensive and requires additional space that may not be available in certain applications.

To overcome the inefficiencies of using a separate boost pump, designers have also tried to incorporate a low NPSH stage within the multistage centrifugal pump housing. Although more convenient than an external boost pump, placing a low NPSH stage within the pump housing restricts the diameter of the NPSH stage. Additionally, because the internal NPSH stage will typically be longer than a standard stage, the balance of the components within the multistage pump must be modified to accommodate the NPSH stage. The additional design and manufacturing efforts required to incorporate an NPSH stage within the pump housing increases lead times and costs. There is, therefore, a need for a cost-effective solution for boosting the NPSH on a horizontal pumping system.

SUMMARY OF THE INVENTION

In some embodiments, the present invention includes a horizontal pumping system that has a motor, a suction chamber and a pump driven by the motor. The pump includes a primary stage assembly and a low NPSH stage assembly connected between the primary stage assembly and the suction chamber.

In another aspect, embodiments herein include a pumping system that includes a motor and a pump driven by the motor. The pump includes a primary stage assembly that has a pump housing and a plurality of turbomachinery stages contained within the pump housing. The pump also includes a low NPSH stage assembly that includes a diffuser connected to the pump housing and a low NPSH impeller contained within the diffuser.

In yet another aspect, embodiments herein include a pumping system that has a motor and a pump driven by the motor. The pump includes a primary stage assembly that has a pump housing having a pump housing diameter and a plurality of turbomachinery stages contained within the pump housing. The pump also includes a low NPSH stage assembly. The low NPSH stage assembly includes a diffuser having a diffuser diameter and a low NPSH impeller contained within the diffuser. In these embodiments, the diffuser diameter is larger than the pump housing diameter.

DETAILED DESCRIPTION

Figure 1:
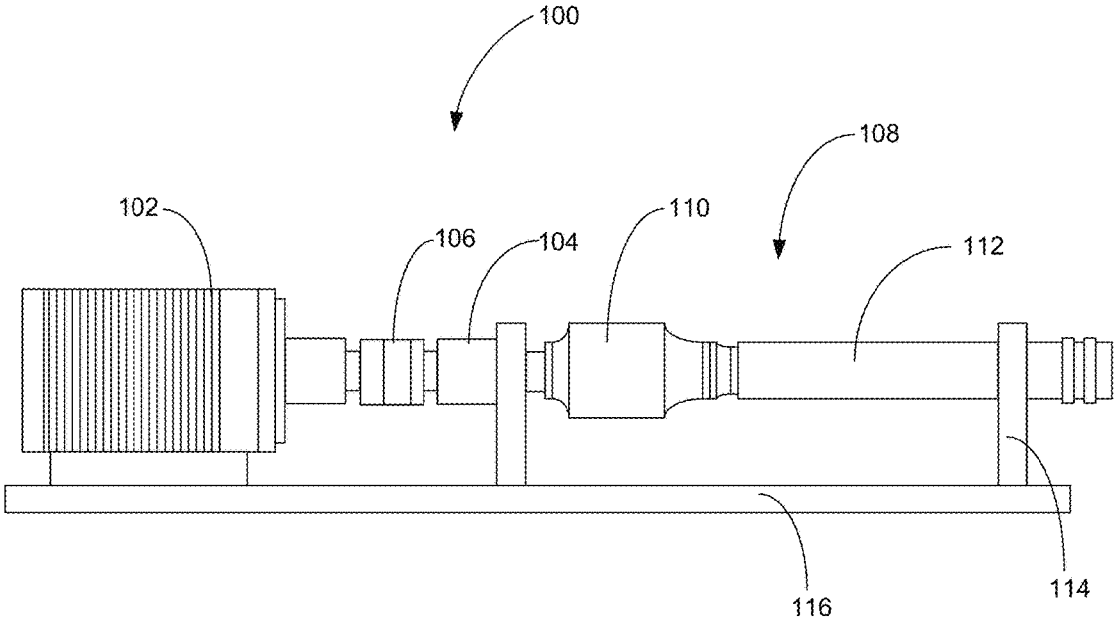
FIG. 1 is a side view of a surface pumping system constructed in accordance with an embodiment.

In accordance with an embodiment of the present invention, FIG. 1 shows a side view of a horizontal pumping system 100, such as for use in the oil and gas industry. The horizontal pumping system 100 includes a motor 102, a suction chamber 104, a thrust chamber 106, and a pump 108. The suction chamber 104 is connected between the thrust chamber 106 and the pump 108. The thrust chamber 106 is connected between the suction chamber 104 and the motor 102. The various components within the horizontal pumping system 100 are supported by a frame 114 and a mounting surface 116. The mounting surface 116 may be a concrete pad, a skid, a rig floor or any other stable surface capable of supporting the horizontal pumping system 100.

Generally, the motor 102 drives the pump 108 through a series of shafts (not visible in FIG. 1) that extend through the thrust chamber 106 and suction chamber 104. Pumped fluids, such as water separated from oil, are provided to the suction chamber 104 from an inlet conduit and pressurized by the pump 108. Unlike prior art pumping systems, the pump 108 of the horizontal pumping system 100 includes a low NPSH stage assembly 110 and a primary stage assembly 112. The low NPSH stage assembly 110 is configured to operate under low net positive suction head (NPSH) conditions. The primary stage assembly 112 is a multistage, high output centrifugal pumping system. The primary stage assembly 112 is contained in a separate housing from the NPSH stage assembly 110. The separate and independent low NPSH stage assembly 110 is configured to intake a fluid under a low NPSH and to provide an increase of the pressure of the pumped fluid to a NPSH required for satisfactory operation of the primary stage assembly 112.

As used herein, the terms "upstream" and "downstream" provide relative positional references to components within the horizontal pumping system 100. Upstream components will be understood to be positioned closer to the suction chamber 104, while downstream components are positioned at a greater distance from the suction chamber 104 in the direction of fluid flow away from the suction chamber 104. Although embodiments herein are depicted in connection with a horizontal pumping system 100, it will be appreciated that embodiments may also find utility in other pumping systems, including surface-mounted vertical pumping systems.

Figure 2:
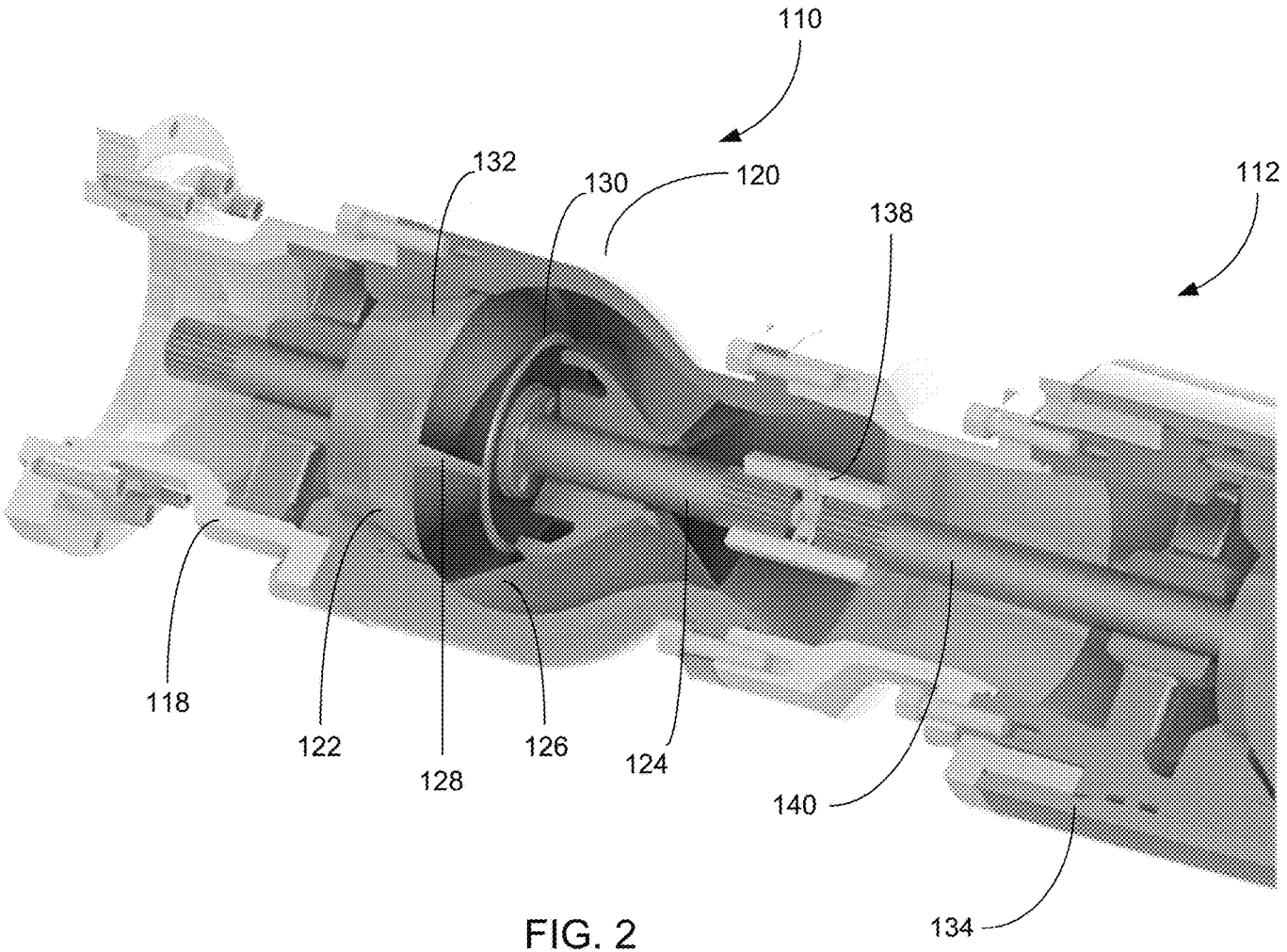
FIG. 2 is a cross-sectional perspective view of low-NPSH stage assembly connected to the multistage assembly.

Turning now to FIG. 2, shown therein is a perspective view of the low NPSH stage assembly 110 and the primary stage assembly 112. The low NPSH stage assembly 110 includes an intake adapter 118, a diffuser 120, an impeller 122 and an intermediate shaft 124. The intake adapter 118 is configured to secure the diffuser 120 to the suction chamber 104 or intervening upstream component. The diffuser 120 includes diffuser vanes 126 and encases the impeller 122. Notably, the diffuser 120 is not contained within a separate external housing. In this way, the diffuser 120 is an independent pressure vessel that can be sized without restriction from an external housing. The diffuser 120 has an interior surface proximate the impeller 122 and an exterior surface exposed to the environment surrounding the horizontal pumping system 100. This permits the diffuser 120 and the impeller 122 to be enlarged and configured to operate under low NPSH conditions while still being driven by the motor 102 with a drive train that is common and connected directly or indirectly to the primary stage assembly 112.

In some embodiments, the impeller 122 is connected to, and configured for rotation with, the intermediate shaft 124. The intermediate shaft 124 carries torque and rotational movement to the impeller 122 from the motor 102. In the embodiment depicted in FIG. 2, the impeller 122 includes a plurality of impeller blades 128, a hub 130 and a shroud 132. The impeller blades 128 are designed to provide an increase in the pressure of the pumped fluid while minimizing cavitation.

The primary stage assembly 112 includes an external pump housing 134, a plurality of turbomachinery stages 136 (not shown in FIG. 2), a shaft coupling 138 and a pump shaft 140. The shaft coupling 138 connects the intermediate shaft 124 to the pump shaft 140, which in turn, drives impellers and other rotating elements within the secondary pump assembly 112 (not shown in FIG. 2). Although the intermediate shaft 124, shaft coupling 138 and pump shaft 140 are used in the embodiment of FIG. 2, it will be appreciated that an alternate embodiment includes the use of a single shaft extending through the low NPSH stage assembly 110 and primary stage assembly 112.

In some embodiments, the low NPSH stage assembly 110 is configured to be installed as a bolt-on module between the suction chamber 104 and the primary stage assembly 112 of the pump 108. The independent and modular nature of the low NPSH stage assembly 110 permits the use of standardized NPSH stage assemblies 110 in concert with a number of primary stage assemblies 112. The ability to use a standardized low NPSH stage assembly 110 reduces manufacturing costs, lowers lead times and facilitates installation and replacement in the field.

Figure 3:
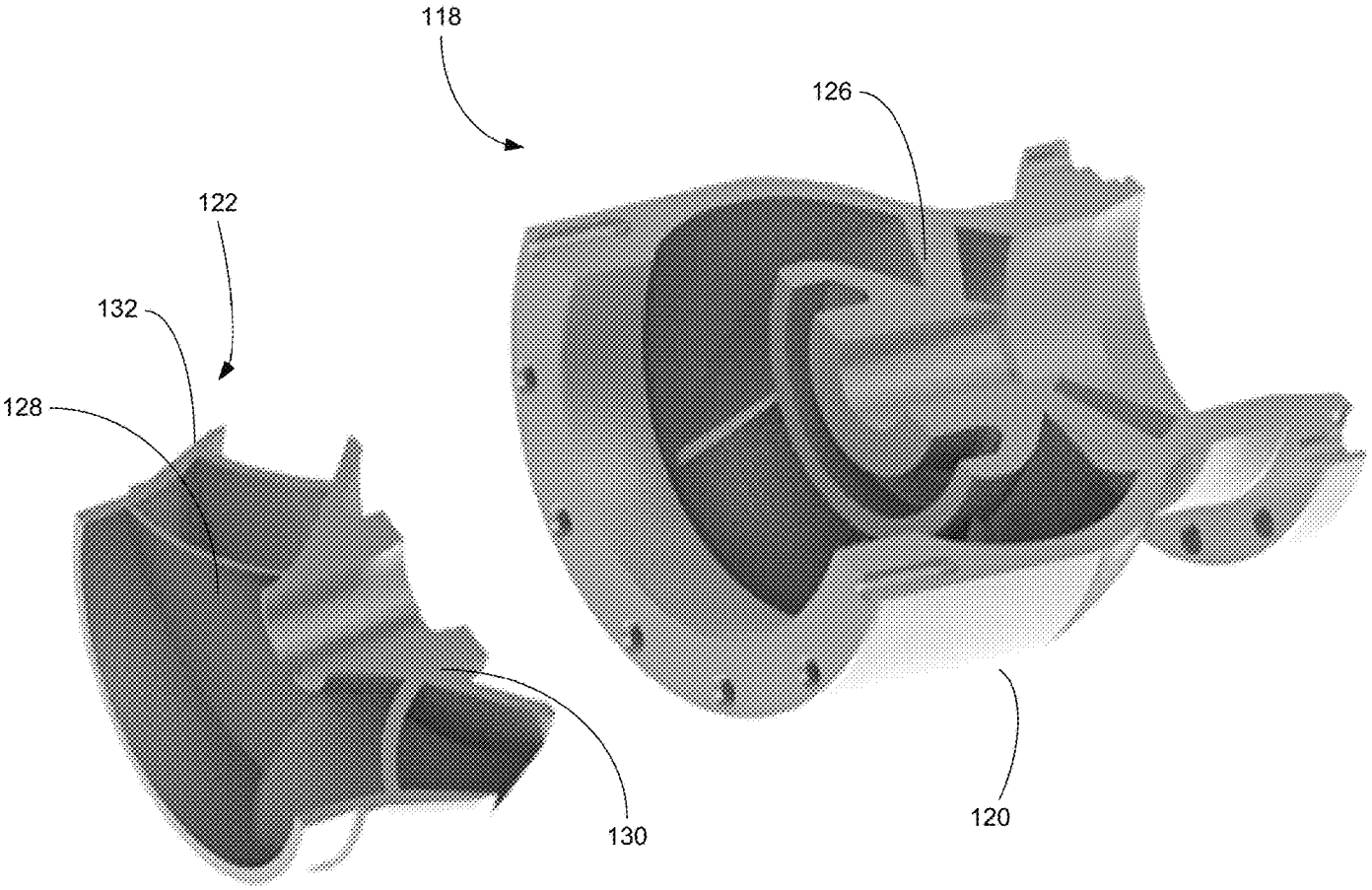
FIG. 3 is a cross-sectional perspective view of the impeller and diffuser from the low-NPSH stage constructed in accordance with a first embodiment.
Figure 4A:
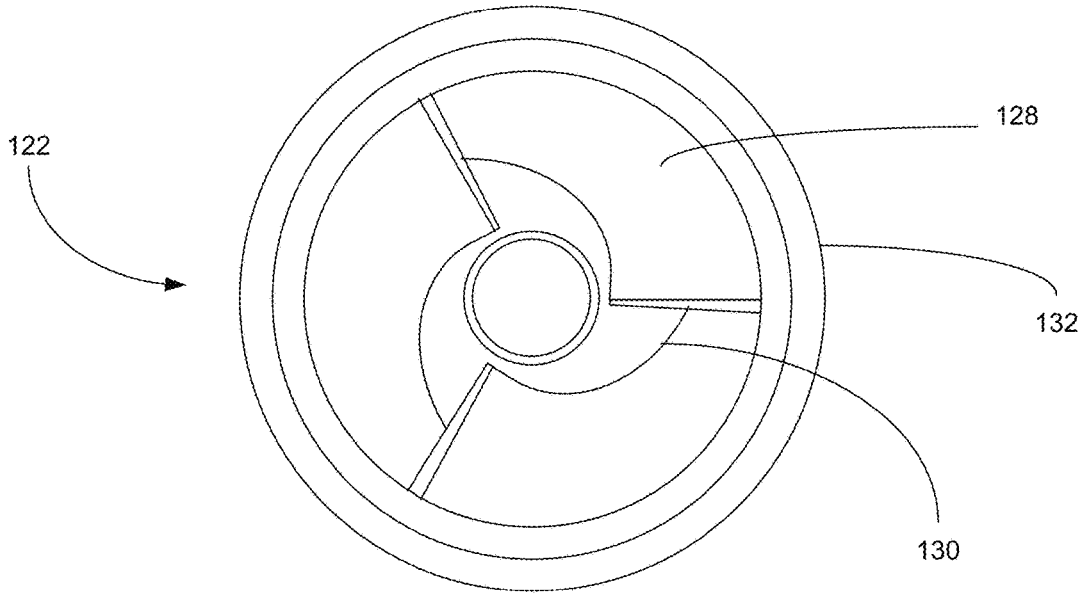
FIG. 4A is a downstream view of the impeller of FIG. 3.
Figure 4B:
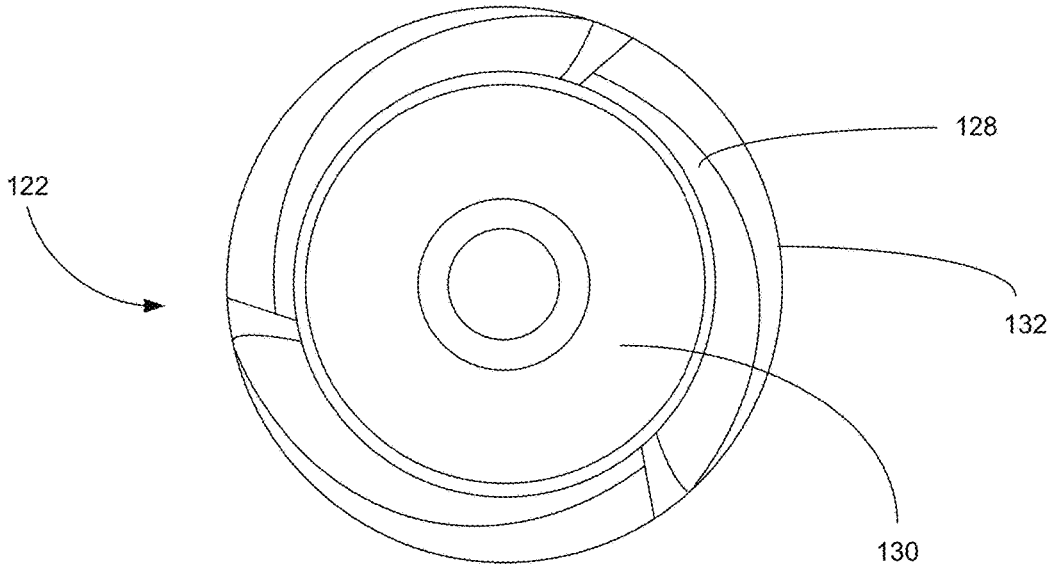
FIG. 4B is an upstream view of the impeller of FIG. 3.
Figure 5:
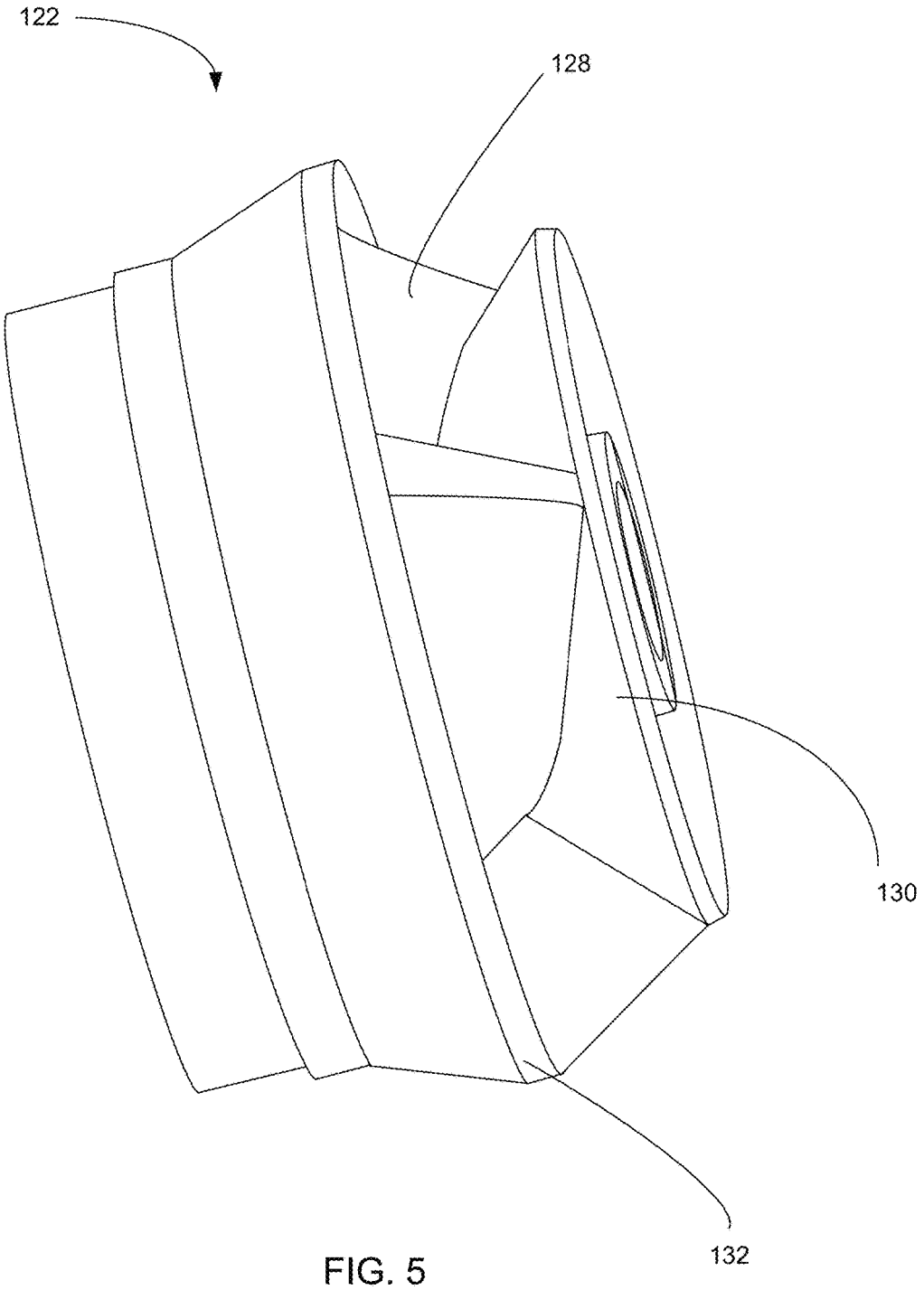
FIG. 5 is a perspective view of the impeller of FIG. 3.

Turning to FIG. 3, shown therein is a cross-sectional, exploded view of the low NPSH stage assembly 110 constructed in accordance with an exemplary embodiment. FIGS. 4A, 4B and 5 provide upstream, downstream and perspective views, respectively, of a first embodiment of the impeller 122 from the low NPSH stage assembly 110. In the first embodiment, the impeller 122 is a mixed flow design that includes a relatively large inlet diameter, a relatively low inlet blade angle and relatively few blades. The combination of these and other design features are intended to minimize the NPSH required for the reliable operation of the low NPSH stage assembly 110.

Although the impeller 122 is depicted as shrouded in FIGS. 3-5, it will be appreciated that the alternate embodiments of the impeller 122 may not include a shroud. Similarly, alternate embodiments of the impeller 122 may also follow a radial impeller design.

Figure 6:
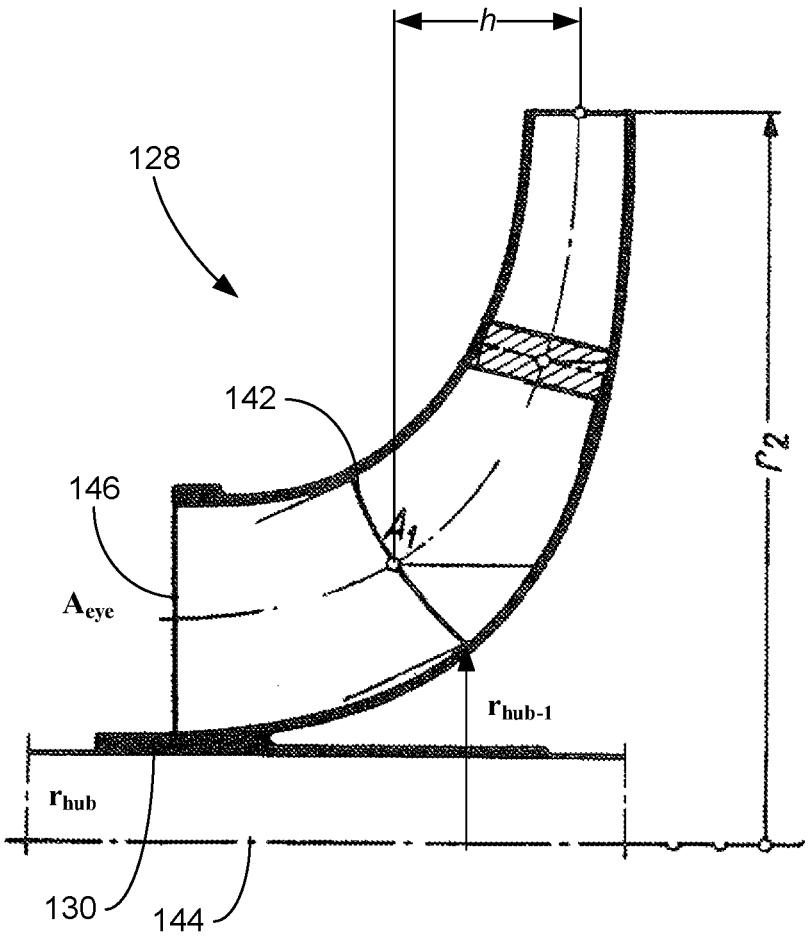
FIG. 6 is a partial cross-sectional depiction of an impeller from a low-NPSH stage constructed in accordance with an embodiment.

Several of the design criteria for the radial and mixed flow embodiments of the impeller 122 are illustrated in the cross-sectional depiction of the blade 128 in FIG. 6. In the embodiment depicted in FIG. 6, the blade 128 includes a curvilinear leading edge 142. To optimize the performance of the impeller 122, the curvature of the leading edge 142 is selected such that the distance from the centerline 144 of the impeller 122 to the interior portion of the leading edge ($r_{hub\text{-}1}$) is greater than the distance from the centerline 144 to the interior portion of the hub 130 ($r_{hub}$). The configuration of the embodiment of the impeller 122 can be further characterized by selecting the area of the eye 146 ($A_{eye}$) of the impeller 122 to be substantially the same as the area of the impeller at the leading edge 142 of the blades 128 ($A_1$). In an embodiment, the inlet meridional curvature of the blade 128 is expressed by noting that the ratio of the length of the blade (h) to the radius of the blade ($r_2$) is greater than 0.6 ($h/r_2>0.6$). These novel design features independently and collectively provide an impeller 122 that is well-suited for operation in low-NPSH conditions.

Figure 7A:
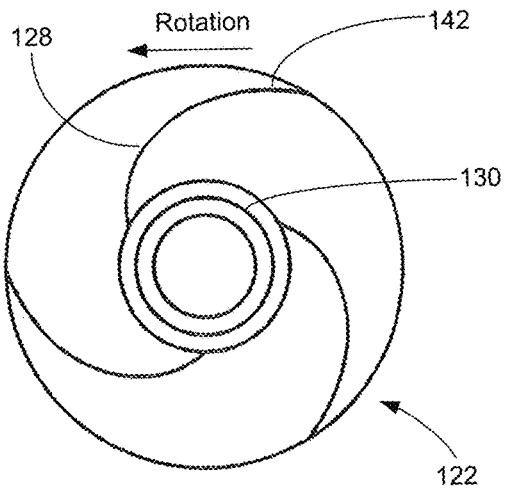
FIG. 7A is an upstream view of an impeller from a low-NPSH stage constructed in accordance with an embodiment.
Figure 7B:
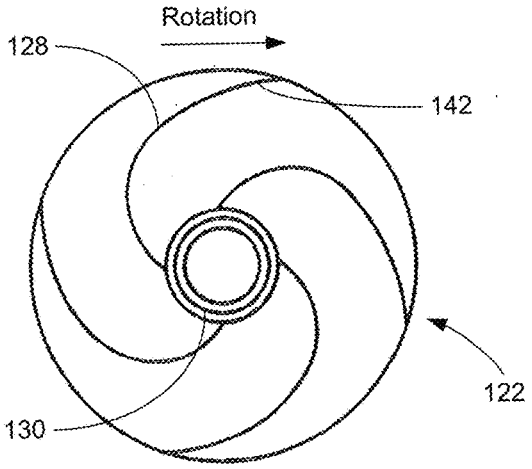
FIG. 7B is an upstream view of an impeller from a low-NPSH stage constructed in accordance with an alternate embodiment.

Turning to FIGS. 7A and 7B, shown therein are upstream views of the impeller 122 constructed in accordance with exemplary embodiments. The impeller 122 depicted in FIG. 7A is configured for rotation in a counterclockwise direction while the impeller 122 depicted in FIG. 7B is configured for rotation in a clockwise direction. As illustrated in the embodiment of FIG. 7A, the blades 128 include a backward-swept leading edge 142. In contrast, in the embodiment depicted in FIG. 7B, the blades 128 include a forward-swept leading edge 142. In an embodiment, the blades 128 have between 0° and 30° of backsweep. In alternate embodiments, the blades 128 have more than 30° of backsweep or are forward-swept. In some embodiments, the impeller 122 includes fewer than six blades 128 and in some embodiments, the impeller 122 includes fewer than five blades 128. The lower number of blades 128 allows the pumped fluid to pass through the impeller 122 with fewer blocking features.

Figure 8:
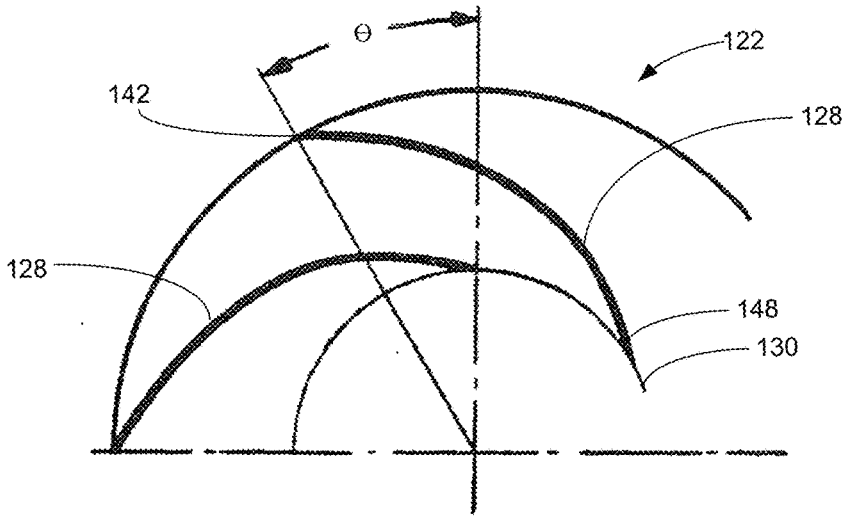
FIG. 8 is a depiction of the blade overlap on an impeller from a low-NPSH stage constructed in accordance with an embodiment.

Turning to FIG. 8, shown therein is a close-up view of the blades 128 of the impeller 122 constructed in accordance with an embodiment. In such embodiments, the blades 128 have an overlap angle "θ" between adjacent leading edges 142 and trailing edges 148 greater than about 30°. In some embodiments, the overlap angle "θ" is greater than about 60°.

Figure 9:
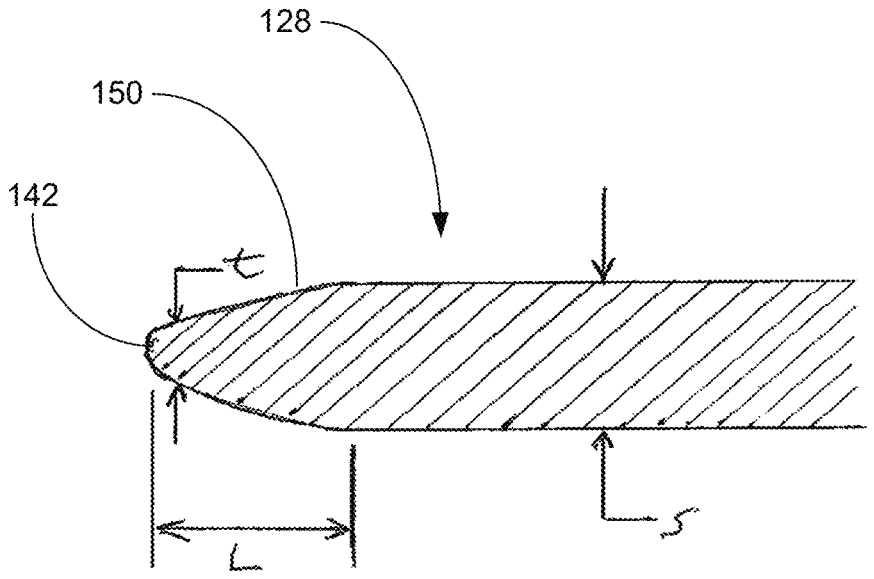
FIG. 9 is a close-up cross-sectional view of the tip of a blade from a low-NPSH stage constructed in accordance with an embodiment depicting an exemplary geometry for the blade tip.

Turning to FIG. 9, shown therein is a close-up cross-sectional view of the tip of a blade 128 constructed in accordance with an exemplary embodiment. The blade 128 has a thin leading edge 142 with a leading edge taper 150 that narrows to a thickness (t). In an embodiment the thickness (t) of the leading edge 142 of the blade 128 is less than half the thickness (s) of the balance of the blade 128 ($t/s<0.5$). In such embodiment, the leading edge taper 150 is characterized by having a length (L) that is greater than the thickness (s) of the blade 128. In some embodiments, the leading edge taper 150 can be defined as having a length to thickness ratio (L/s) of greater than 2.5.

Figure 10:
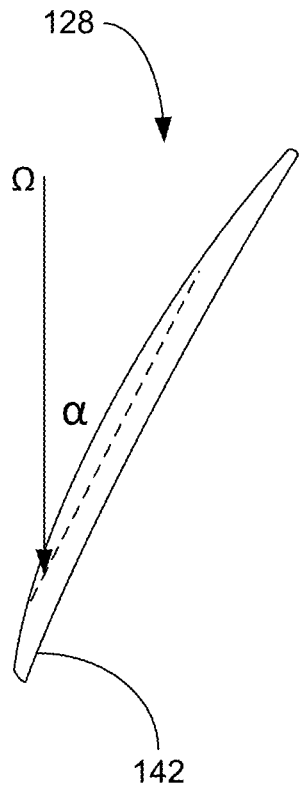
FIG. 10 is a depiction of the leading edge of an impeller showing the blade angle to the pumped fluid.

Turning to FIG. 10, shown therein is a depiction of the leading edge 142 of the blade 128 and the direction of rotation of the blade 128. The blade angle ($\alpha$) is defined as the inclination of the tangent to the blade in the meridional plane and the plane perpendicular to the axis of rotation ($\Omega$). As noted in FIG. 10, the blade angle ($\alpha$) is relatively small. In some embodiments, the leading edge 142 of the blade 128 is configured such that the blade angle at the tip of the blade 128 at the inlet is less than about 17° and even more particularly less than about 15°.

In this configuration, the blades 128 of the impeller produce a relatively low inlet flow coefficient. In some embodiments, the inlet flow coefficient at the tip is less than about 0.25 and in some embodiments the inlet flow coefficient at the tip is less than about 0.2. As used herein, the term "flow coefficient" will be understood to refer to the ratio of inlet axial velocity to blade rotational velocity at the tip of the blade 128.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

What is claimed is:

1. A horizontal pumping system comprising:
a motor;
a suction chamber; and
a pump assembly driven by the motor, wherein the pump assembly comprises:
a primary stage assembly, wherein the primary stage assembly includes a pump housing; and
a low NPSH stage assembly connected between the primary stage assembly and the suction chamber, wherein the low NPSH stage assembly comprises:
a diffuser that is fastened between the pump housing and the suction chamber;
an impeller contained within the diffuser, wherein the impeller includes a plurality of blades each having an inlet meridional curvature, a length (h) and a radius ($r_2$), and wherein each of the plurality of blades has a ratio of length (h) to radius ($r_2$) of greater than 0.6; and
an intermediate shaft.

2. The horizontal pumping system of claim 1, wherein the diffuser comprises a pressure vessel.

3. The horizontal pumping system of claim 1, wherein the impeller comprises a radial flow impeller.

4. The horizontal pumping system of claim 1, wherein the impeller comprises a mixed flow impeller.

5. The horizontal pumping system of claim 1, wherein the impeller includes fewer than five blades.

6. The horizontal pumping system of claim 1, wherein each of the plurality of blades has a curvilinear leading edge.

7. The horizontal pumping system of claim 1, wherein each of the plurality of blades comprises a leading edge and a trailing edge, and wherein each leading edge overlaps the trailing edge of an adjacent one of the plurality of blades by an amount greater than 30°.

8. The horizontal pumping system of claim 1, wherein the impeller exhibits an inlet flow coefficient of less than 0.25.

9. The horizontal pumping system of claim 1, wherein each of the plurality of blades has a blade body and a leading edge, and wherein the blade body has a blade body thickness and the leading edge has a leading edge thickness, and wherein the leading edge thickness is less than one-half the blade body thickness.

10. The horizontal pumping system of claim 1, wherein each of the plurality of blades is configured to provide a blade angle of less than 17°.

11. The horizontal pumping system of claim 1, wherein the impeller includes a shroud.

12. A pumping system comprising:
a motor;
a suction chamber;
a shaft driven by the motor and extending through the suction chamber;
a pump driven by the motor, wherein the pump comprises:
a primary stage assembly, wherein the primary stage assembly includes a pump housing having a pump housing outer diameter and a plurality of turbomachinery stages contained within the pump housing;
a low NPSH stage assembly removably connected between the pump housing and the suction chamber, wherein the low NPSH stage assembly includes a diffuser having a diffuser outer diameter connected to the pump housing and a low NPSH impeller contained within the diffuser; and
wherein the diffuser outer diameter is larger than the pump housing outer diameter.

13. The pumping system of claim 12, wherein the primary stage assembly and low NPSH stage assembly are driven by a common shaft.

14. The pumping system of claim 13, wherein the low NPSH stage includes an intermediate shaft and wherein the primary stage assembly includes a pump shaft and a shaft coupling, wherein the shaft coupling connects the intermediate shaft to the pump shaft.

15. A pumping system comprising:
a motor;
a pump driven by the motor, wherein the pump comprises:
a primary stage assembly, wherein the primary stage assembly includes a pump housing having a pump housing outer diameter and a plurality of turbomachinery stages contained within the pump housing;
a low NPSH stage assembly, wherein the low NPSH stage assembly includes a diffuser having a diffuser diameter and a low NPSH impeller contained within the diffuser; and
wherein the diffuser diameter is larger than the pump housing outer diameter.

* * * * *